US007237462B1

(12) United States Patent
Liau

(10) Patent No.: US 7,237,462 B1
(45) Date of Patent: Jul. 3, 2007

(54) HAND TOOL WITH A HANDLE MADE BY DIFFERENT MATERIAL

(76) Inventor: Jia-Guann Liau, No. 37-2, Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/388,590

(22) Filed: Mar. 27, 2006

(51) Int. Cl.
*B25B 23/16* (2006.01)
*B25B 13/00* (2006.01)

(52) U.S. Cl. ..... 81/177.1; 81/124.7; 81/125.1; 81/900

(58) Field of Classification Search ..... 81/177.1, 81/900, 177.7, 177.8, 125.1, 119, 121.1, 124.7
See application file for complete search history.

(56) References Cited

U.S. PATENT DOCUMENTS

| | | | | | |
|---|---|---|---|---|---|
| 216,690 | A * | 6/1879 | Mikkelson | ..... | 81/125.1 |
| 2,909,954 | A * | 10/1959 | Rhoads | ..... | 81/186 |
| 2,978,353 | A * | 4/1961 | Meier | ..... | 81/125.1 |
| 4,986,147 | A * | 1/1991 | Cooper | ..... | 81/177.1 |
| 5,062,328 | A * | 11/1991 | Demurger | ..... | 81/186 |
| D325,864 | S * | 5/1992 | Diego | ..... | D8/28 |
| 6,318,216 | B1 * | 11/2001 | Eggert et al. | ..... | 81/900 |
| 6,637,299 | B1 * | 10/2003 | Steele | ..... | 81/125.1 |
| 6,899,002 | B2 * | 5/2005 | Willis, Sr. | ..... | 81/177.7 |
| 7,117,767 | B1 * | 10/2006 | Kiat | ..... | 81/125.1 |
| 2005/0022631 | A1 * | 2/2005 | Brazil | ..... | 81/119 |

* cited by examiner

*Primary Examiner*—Hadi Shakeri
(74) *Attorney, Agent, or Firm*—WPAT, P.C.; Anthony S King

(57) ABSTRACT

A hand tool includes a handle made of a first material and at least one driving head connected to an end of the handle and the at least one driving head is made by a second material. A protection layer is coated onto the driving head and the handle. The first material can be Chrome-Vanadium alloy and the second material can be medium carbon steel.

4 Claims, 6 Drawing Sheets

HAND TOOL WITH A HANDLE MADE BY DIFFERENT MATERIAL

FIELD OF THE INVENTION

The present invention relates to a hand tool wherein the driving head and the handle are made by different material so that the manufacturing cost is reduced while the function of the handle tool is maintained.

BACKGROUND OF THE INVENTION

A conventional hand tool is shown in FIG. 8 and generally includes an elongate handle 5 and two driving ends 6 and 7 which are an open end and a box end respectively. The driving end 6 has a clamp opening 60 and the box end has a polygonal hole 70 so as to engage a workpiece such as a nut, a bolt or the like. The conventional hand tool generally is made integrally by the same material which generally is alloy. The alloy is hard enough so that the hand tool does not deform when applying a torque to the workpieces. However, the alloy is expensive and the handle does not contact the workpieces so that the handle is not necessarily to be made by the expensive alloy. If the hand tool is made by less harder material such as medium carbon steel, some workpieces are harder than the driving ends 6 and 7 and the driving ends of the hand tool will be worn out quickly.

The present invention intends to provide a hand tool that is made by two different materials wherein the driving ends are made by harder material and the handle is made by less harder material so that the manufacturing cost is reduced while the function of the handle tool is maintained.

SUMMARY OF THE INVENTION

The present invention relates to a hand tool that comprises a handle made of a first material and at least one driving head is connected to an end of the handle and made by a second material. A protection layer is coated onto at least the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
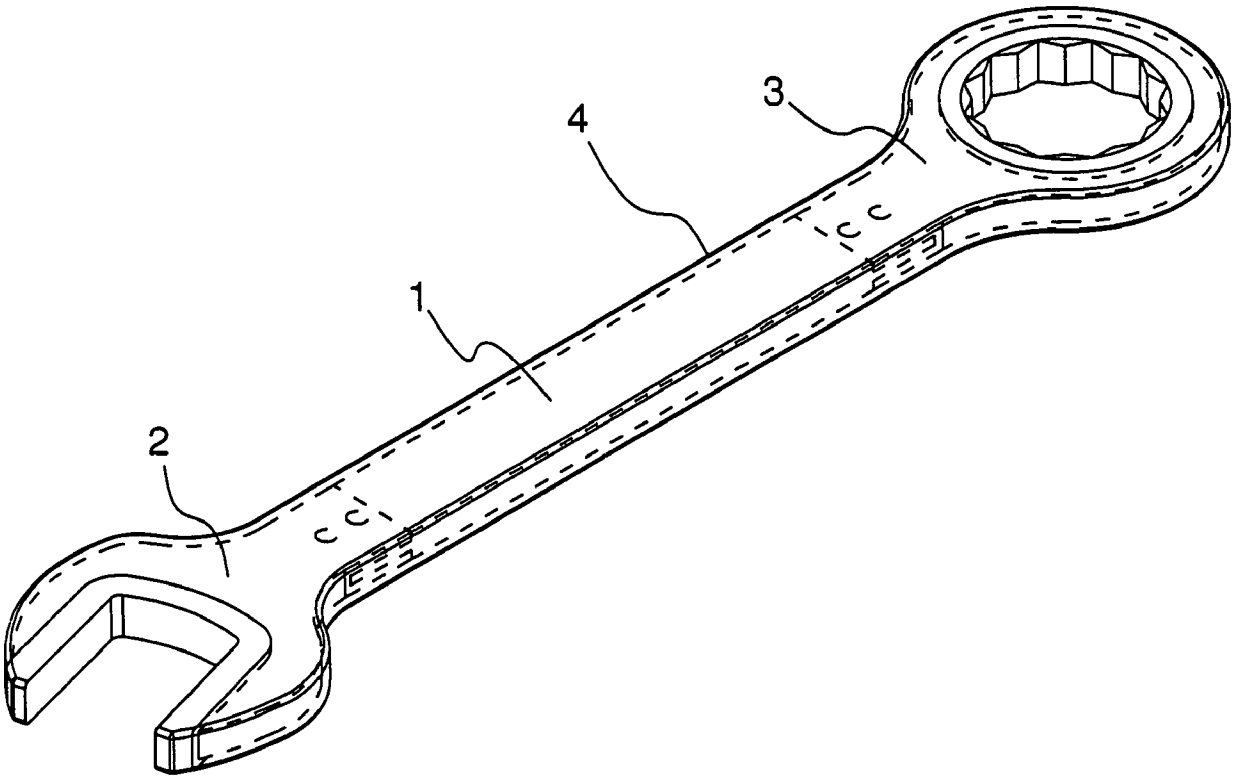
FIG. 1 is a perspective view to show the hand tool of the present invention.
Figure 2:
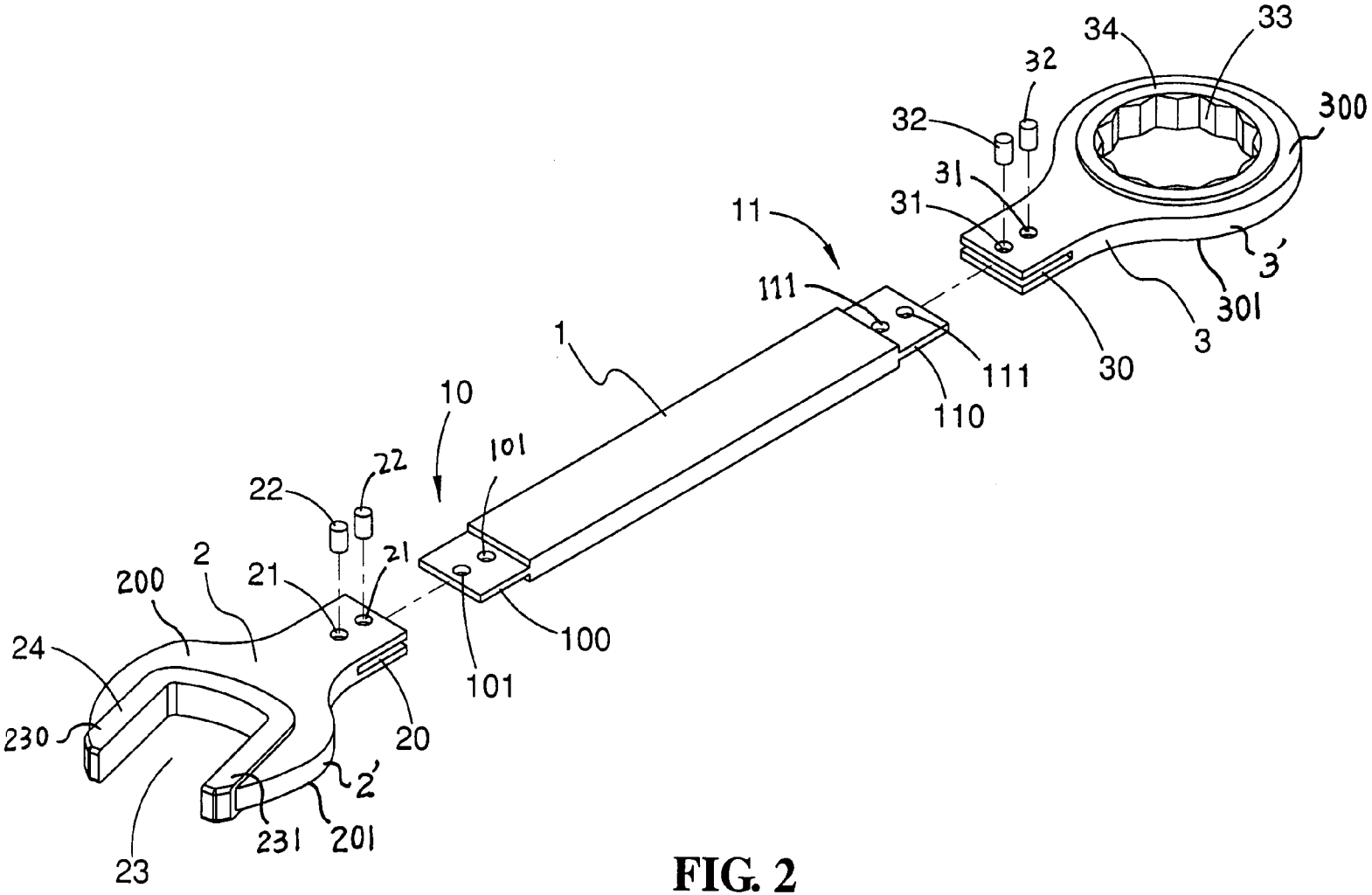
FIG. 2 is an exploded view to show the hand tool of the present invention.
Figure 3:
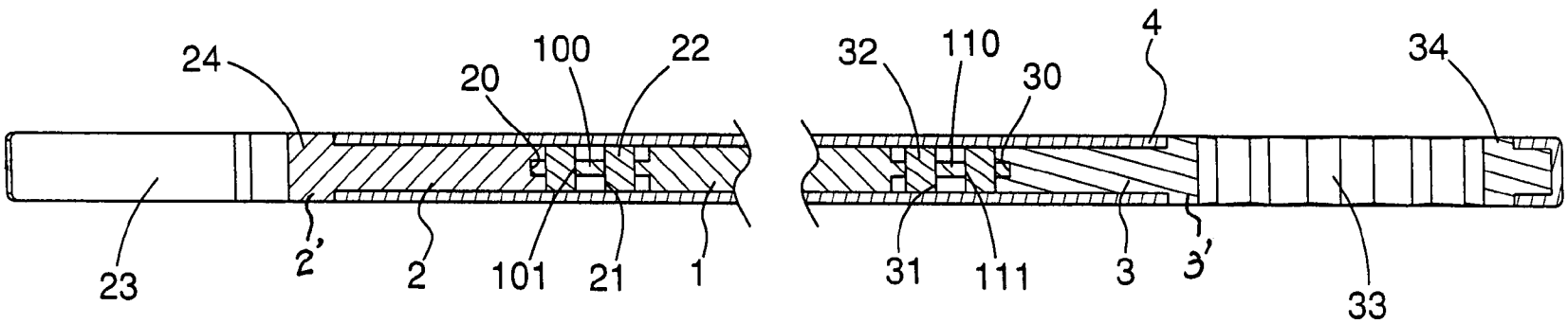
FIG. 3 is a cross sectional view of the hand tool of the present invention.

Referring to FIGS. 1 to 3, the hand tool of the present invention comprises a handle 1 made of a first material such as medium carbon steel and two driving heads 2, 3 connected to two ends 10, 11 of the handle 1, and the two driving heads 2, 3 are made by a second material such as Chrome-Vanadium alloy. In this embodiment, the two driving heads 2, 3 are an open end wrench head 2' and a box end wrench head 3'. The open end wrench head 2' includes an engaging space 23 defined between the two jaws 230, 231 thereof and the box end wrench head 3' includes another engaging space 33 such as a polygonal hole defined therethrough so that a workpiece (not shown) such as a nut, a bolt or the like can be clamped in the engaging space 23, 33.

Two connection ends 100, 110 extend from the two ends of the handle 1 and each of the connection ends 100, 110 includes two first holes 101/111 defined therethrough. The two driving heads 2, 3 each have a slot 20/30 defined therein and two second holes 21/22 are defined through each of the driving heads 2, 3 and communicate with the slot 20/30. The two connection ends 100, 110 are inserted into the slot 20, 30 respectively and two pins 22/32 extend through the second holes 21/22 and the first holes 101/111 to connect the two driving heads 2, 3 to the handle 1. The two driving heads 2, 3 can be wrench heads 2', 3', each wrench head 2', 3' has two opposite sides 200, 201/300, 301 and includes an engaging space 23/33 defined through the two opposite sides 200, 201/300, 301, and each wrench head 2', 3' includes a raised portion 24/34 extending from each of the two opposite sides 200, 201/300, 301 thereof and each of the raised portions 24, 34 respectively enclosing the engaging space 23, 33.

A protection layer 4 is coated onto the handle 1 and the driving heads 2, 3. The protection layer 4 is coated to the driving heads 2, 3 and in flush with the raised portions 24/34. The protection layer 40 can be made of plastic, fiber reinforcement plastic or rubber.

The hand tool includes two different materials wherein the driving heads 2 and 3 are made by alloy which is harder than the medium carbon steel which is used to make the handle 1. By this way, the manufacturing cost can be reduced while the driving heads 2 and 3 maintain their expected function. The protection layer 40 improves the grip of the user's hand and hides the pins 22, 32. The protection layer 40 can also be coated onto the handle 1 only. The protection layer 40 can be consisted of different sections with different material when needed.

Figure 4:
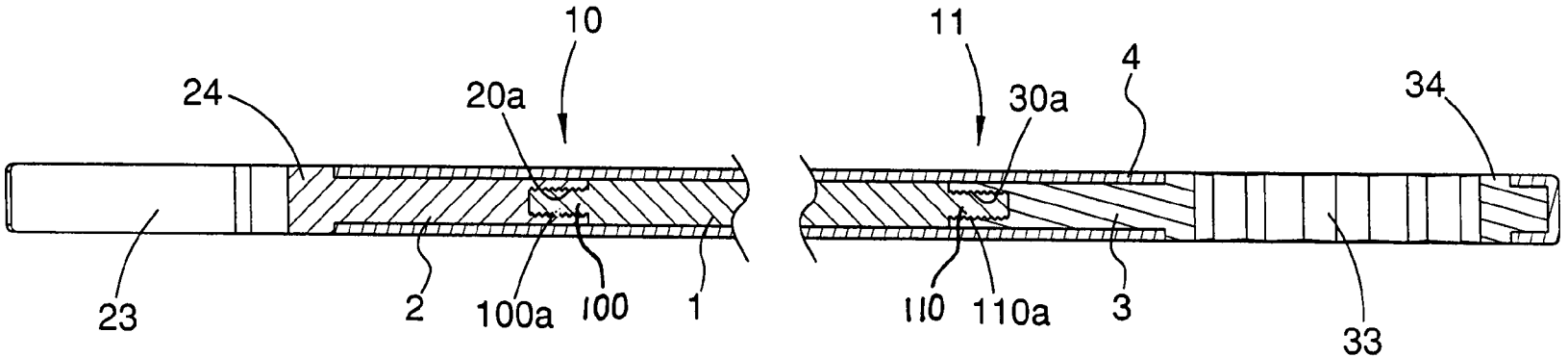
FIG. 4 shows that the driving heads are threadedly connected to the handle.
Figure 5:
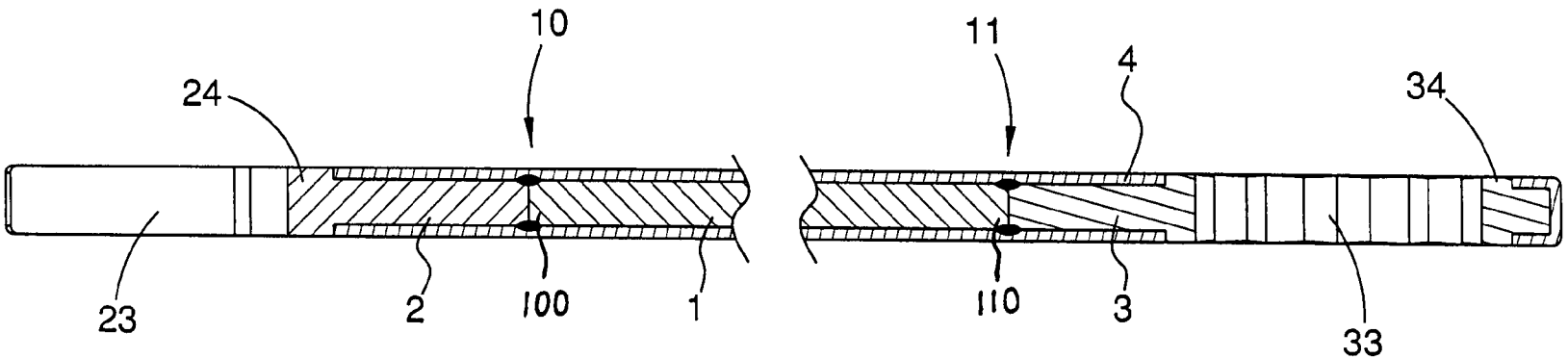
FIG. 5 shows that the driving heads are welded to the handle.

FIG. 4 shows that the connection ends 100, 110 each have a threaded protrusion 100*a*/110*a* and the two driving heads 2, 3 each have a threaded hole 20*a*/30*a* with which the threaded protrusion 100*a*/110*a* is connected. FIG. 5 shows that the connection ends 100, 110 are respectively welded to the driving heads 2, 3.

Figure 6:
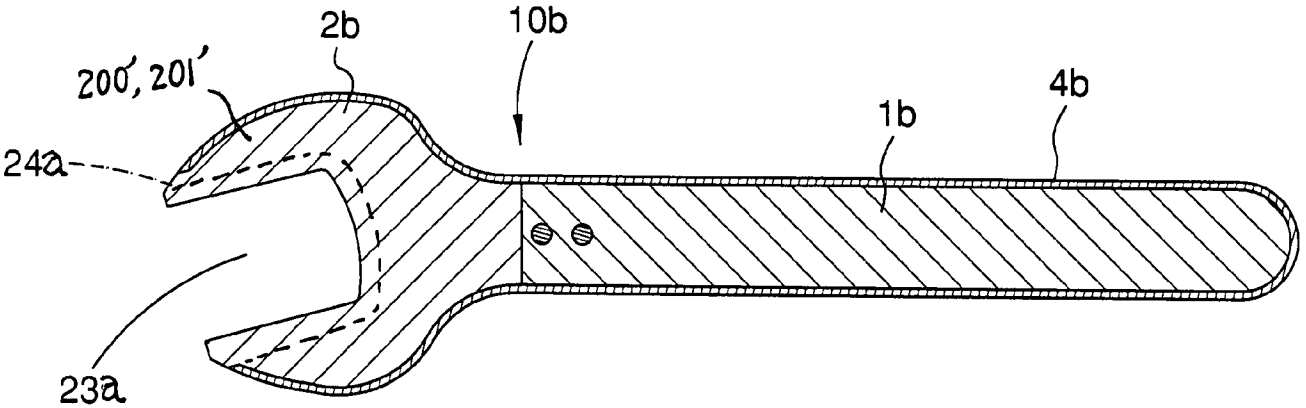
FIG. 6 shows that the handle tool is an open end wrench.
Figure 7:
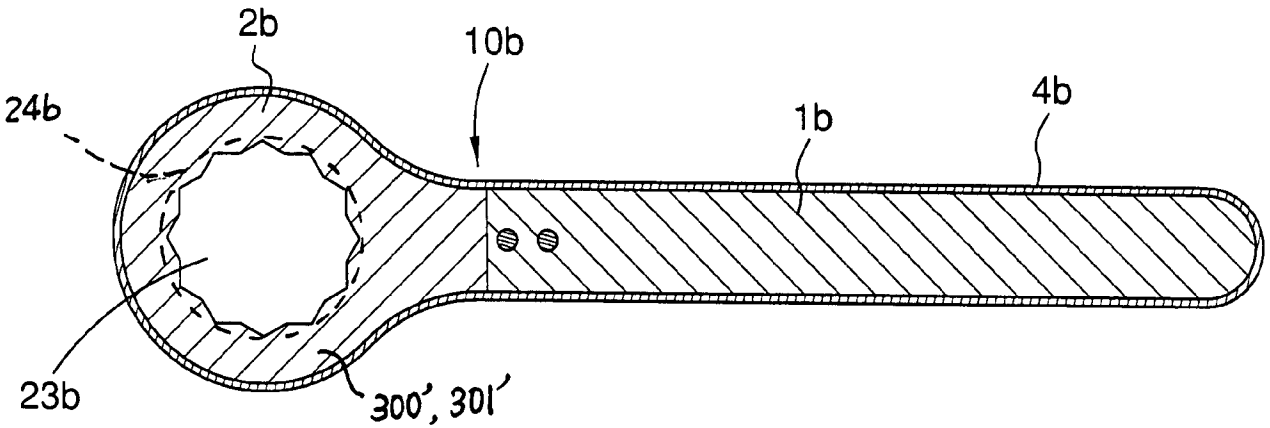
FIG. 7 shows that the handle is a box end wrench.
Figure 8:
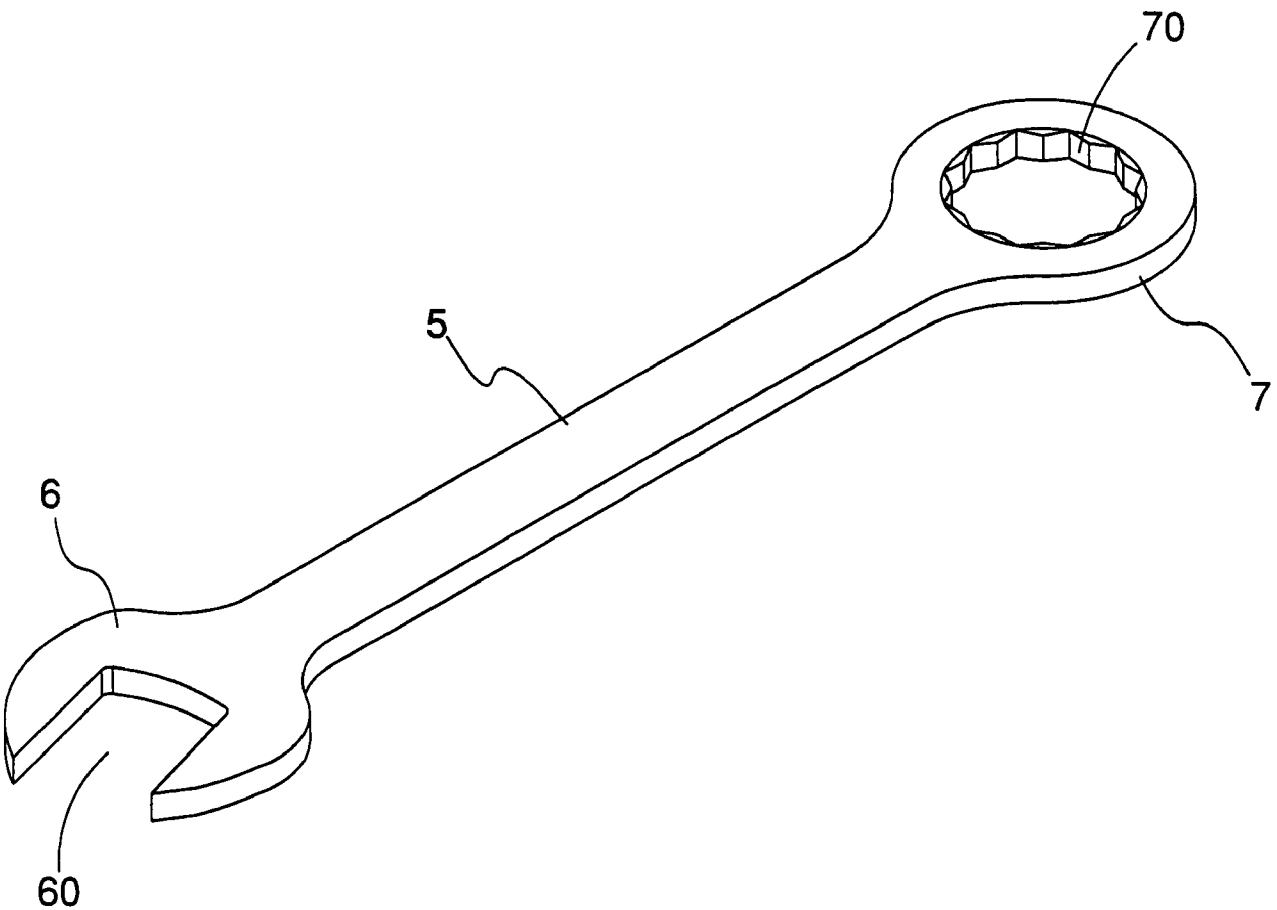
PRIOR ART FIG. 8
FIG. 8 is a perspective view to show a conventional hand tool.

FIGS. 6 and 7 show that the hand tool includes a handle 1*b* with only one driving head 2*b* which can be an open end wrench head or a box end wrench head. As shown in FIG. 6, the driving head 2*b* is an open end wrench head including an U-shaped engaging space 23*a* which is enclosed by a raised portion 24*a* on each of the two opposite sides 200', 201'. As shown in FIG. 7, the driving head 2*b* is a box end wrench head including an engaging space 23*b* which is a polygonal hole. The polygonal hole is enclosed by a raised portion 24*b* on each of the two opposite sides 300', 301' of the driving head 2*b*.

While we have shown and described the embodiment in accordance with the present invention, it should be clear to those skilled in the art that further embodiments may be made without departing from the scope of the present invention.

What is claimed is:

1. A hand tool comprising:

a handle having two ends and made of a first material, and two connection ends each respectively extending from each of the two ends of the handle;

two driving heads, each of the two driving head made by a second material, and respectively connected to the two connection ends of the handle, the two driving heads are an open end wrench head and a box end wrench head, each said wrench head has two opposite sides, the open end wrench head includes an engaging space defined between two jaws thereof and the box end wrench head includes another engaging space defined through the two opposite sides; and a protection layer coated onto the two driving heads and the handle;

wherein each of the two connection ends includes two first holes and each of the two driving heads has a slot defined therein, two second holes are defined through each of the two driving heads and communicate with the slot, each of the two connection ends is respectively inserted into the slot of each of the two driving heads, and two pins extend through the second holes and the first holes, each of the two driving heads includes a raised portion extending from each of the two opposite sides thereof and enclosing the engaging space, and the protection layer is coated to the two driving heads and in flush with the raised portions.

2. The hand tool as claimed in claim 1, wherein the protection layer is made of plastic.

3. The hand tool as claimed in claim 1, wherein the protection layer is made of fiber reinforcement plastic.

4. The hand tool as claimed in claim 1, wherein the protection layer is made of rubber.

* * * * *